US006904776B1

(12) United States Patent
Lin

(10) Patent No.: US 6,904,776 B1
(45) Date of Patent: Jun. 14, 2005

(54) COMBINATION LOCK CAPABLE OF BEING OPENED BY A KEY

(76) Inventor: Chu Pao-feng Lin, No. 4, Dachang Rd., Ciaotou Township, Kaohsiung County (TW)

( * ) Notice: Subject to any disclaimer, the term of this patent is extended or adjusted under 35 U.S.C. 154(b) by 42 days.

(21) Appl. No.: 10/756,071

(22) Filed: Jan. 12, 2004

(51) Int. Cl.[7] ..... E05B 37/10
(52) U.S. Cl. ..... 70/25; 70/21; 70/319; 70/284; 70/DIG. 71
(58) Field of Search ..... 70/21, 25, 28, 70/38 C, 38 A, 38 B, 42–44, 312, 319, DIG. 71, 70/284, 285

(56) References Cited

U.S. PATENT DOCUMENTS 5,715,709 A * 2/1998 Lai ..... 70/25
6,012,309 A * 1/2000 Liu ..... 70/25
6,029,481 A * 2/2000 Lai ..... 70/25
6,035,672 A * 3/2000 Lai ..... 70/25
6,474,116 B1 * 11/2002 Lai ..... 70/25
6,539,761 B2 * 4/2003 Yang ..... 70/284
6,615,626 B2 * 9/2003 Yu et al. ..... 70/301
6,675,614 B2 * 1/2004 Lai ..... 70/25
6,708,534 B1 * 3/2004 Ruan ..... 70/38 A
6,729,166 B1 * 5/2004 Lai ..... 70/25

* cited by examiner

*Primary Examiner*—John B. Walsh
(74) *Attorney, Agent, or Firm*—Pro-Techtor International Services

(57) ABSTRACT

Disclosed is a combination lock wherein responsive to unlocking the lock, use a tool to press the push button to advance a push button and a locking pin inside until a passage is clear from a ledge, insert a pointed portion of the tool into an indentation on a push button, rotate the push button to engage a projection with a tooth, further press the push button to advance a locking pin inside and matingly engage the push button with the locking pin, and rotate the push button and the locking pin until the ledge inserts into the passage with a spring biased pin being entered into an aperture of a sliding seat for locking during an operation of inhibiting the lock from being opened by a key.

2 Claims, 16 Drawing Sheets

A~A'

B ~ B'

COMBINATION LOCK CAPABLE OF BEING OPENED BY A KEY

BACKGROUND OF THE INVENTION

1. Field of the Invention

The present invention relates to combination locks and more particularly to a combination lock which can be opened by an authorized person by means of a key in addition to the typical opening by arranging dials into a numeral sequence desired by the user. Further, the authorization can be inhibited.

2. Description of Related Art

Combination locks are well known. One particular type of combination lock is disclosed in U.S. Pat. No. 5,715,709. While the patent may be suitable for the particular purpose to which it addresses, it still has the drawbacks of being weak of certain components, possible loosening of sealing cap, and difficult of manufacturing due to excessive internal components. Moreover, it is known that a padlock can only be opened by a key. Unfortunately, an integral combination lock and padlock has not been disclosed as far as the present inventor is aware. Further, it is understood that a user may forget the combination of a combination lock if its correct numeral sequence has been changed for several times. For solving the problem, it is desirable to provide a novel combination lock which, in addition to the typical opening by arranging dials into a numeral sequence desired by a user, it can be opened by an authorized person by means of a key. Inhibition of the authorization is also desirable.

SUMMARY OF THE INVENTION

It is an object of the present invention to provide a combination lock, comprising a substantially parallelepiped body including an elongated shackle receiving bore, a shallow shackle receiving hole on a top of the body opposite the bore, a plurality of parallel dial receiving slots crossed the bore, a plurality of ridged in an inner wall of the bore, each ridge being adjacent the dial receiving slot, a longitudinal groove adjacent and parallel with the bore, a channel perpendicular to the groove, a key hole perpendicular to the channel, a cavity recessed from the shackle receiving hole and aligned with the key hole, the cavity including a lengthwise ledge, a seat at both sides of the cavity, and a seat cover rested on the seat; a housing including mated upper and lower panels each including a dial receiving recess, a first half-circular indentation aligned with the bore, a second half-circular indentation aligned with the shackle receiving hole, and a third half-circular indentation aligned with the key hole; a plurality of separate and independent rotatable dials mounted at the dial receiving slots, each dial including a plurality of slits on an inner surface and a plurality of numeral panels on an outer surface; a plurality of tumbler sleeves each rotatably provided in the inner surface of the dial, each tumbler sleeve including a plurality of radial fins and a substantially flat member around an outer surface wherein the number of the fins is less than that of the slits by one; a resilient element including a plurality of pegs mounted in the dial receiving slots wherein each peg is forced to engage with the outer surface of the dial; a washer tightly fitted on a mouth of the bore for preventing any external contaminants from reaching inside; an elongated key lock assembly mounted in the key hole, the key lock assembly including an inward projection having a cam section; a sliding seat fitted onto the groove and the channel, the sliding seat including an opening aligned with the key hole so as to receive the projection and cause the sliding seat to be slidable by turning the key lock assembly, an aperture in communication with the opening and having a diameter smaller than that of the opening, and a plurality of legs each aligned with a portion of the body between two adjacent dial receiving slots, each leg having a substantially arcuate member; a U-shaped shackle including a short leg having its end insertable into the shackle receiving hole, and a long leg having its end inserted into a bottom of the bore and being allowed to advanced axially a distance along the bore in a locking or unlocking operation; a push button disposed in the cavity being proximate the shackle receiving hole, the push button including a toothed section around an inner surface and two opposite indentations on an outer surface; and a spring biased locking pin including a toothed member around an end, a plurality of equally spaced raised portions adjacent the toothed member with a passage formed between any two adjacent raised portions and the ledge being fitted in one of the passages, a plurality of slopes each at the raised portion, a shaft aligned with the aperture, and a spring put on the shaft, wherein the ridge is inserted into a valley between two adjacent fins of each tumbler sleeve for locking with the arcuate members being urged against the flat member; the dials are arranged into a predetermined numeral sequence by disengaging the arcuate members from the fins for unlocking; insert a key into the key hole to rotate the projection for sliding the sliding seat and disengaging the arcuate members from the fins; in response to unlocking the lock, use a tool to press the push button to advance the push button and the locking pin inside until the passage is clear from the ledge, insert a pointed portion of the tool into at least one of the indentations, rotate the push button to engage the projection with the slope, further press the push button to advance the locking pin inside and matingly engage the toothed member with the toothed section, and rotate the push button and the locking pin until the ledge inserts into the passage with the shaft being entered into the aperture for locking the sliding seat during an operation of inhibiting the lock from being opened by the key; and responsive to unlocking the lock, pull the long leg by a plurality of steps wherein in each step the fins of the tumbler sleeve are completely withdrawn from the slits and are locked by one adjacent ridge, thereby enabling a change of one numeral of a predetermined combination.

The above and other objects, features and advantages of the present invention will become apparent from the following detailed description taken with the accompanying drawings.

DETAILED DESCRIPTION OF THE PREFERRED EMBODIMENTS

Figure 1:
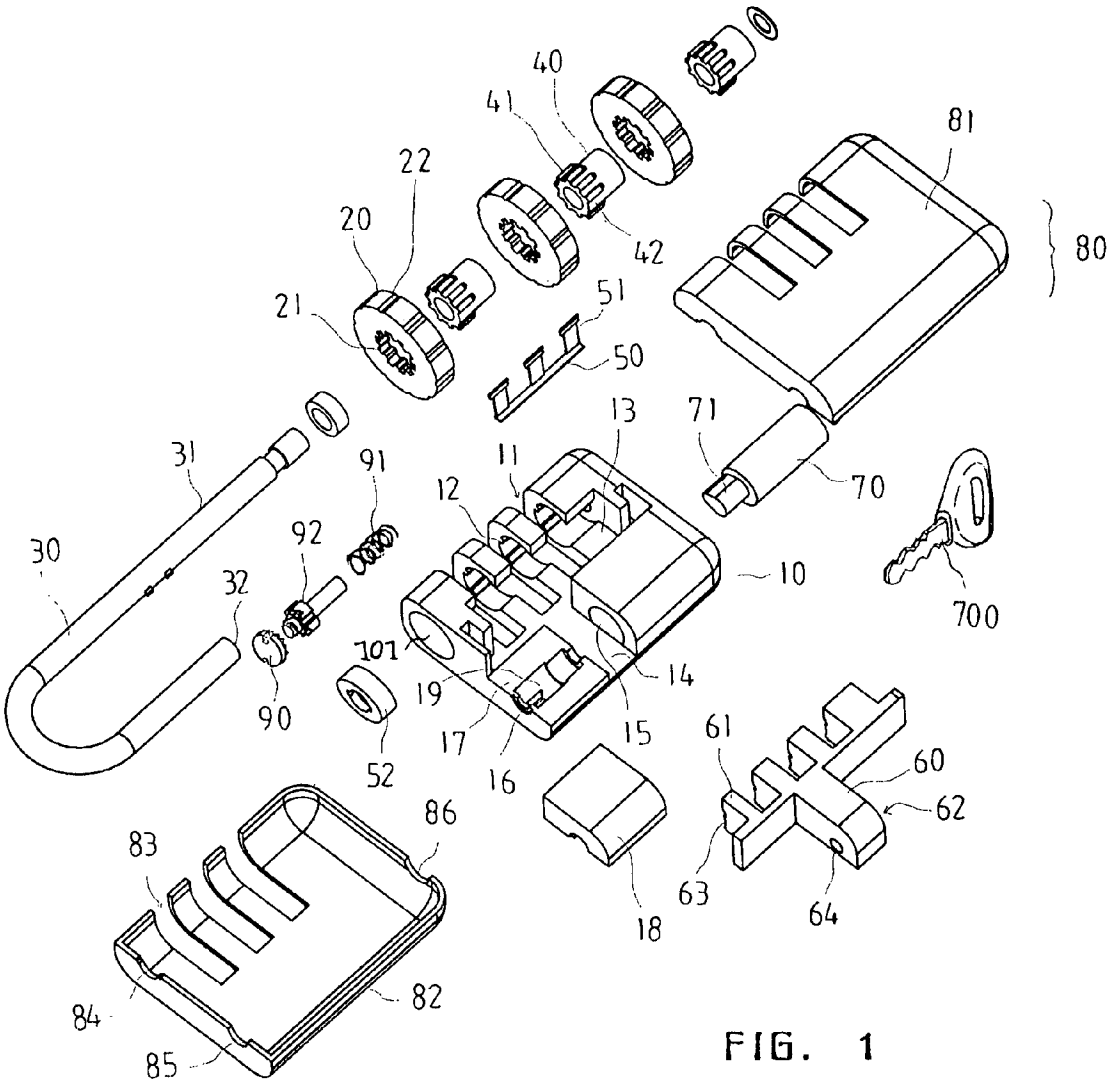
FIG. 1 is an exploded view of a preferred embodiment of combination lock according to the invention.
Figure 2:
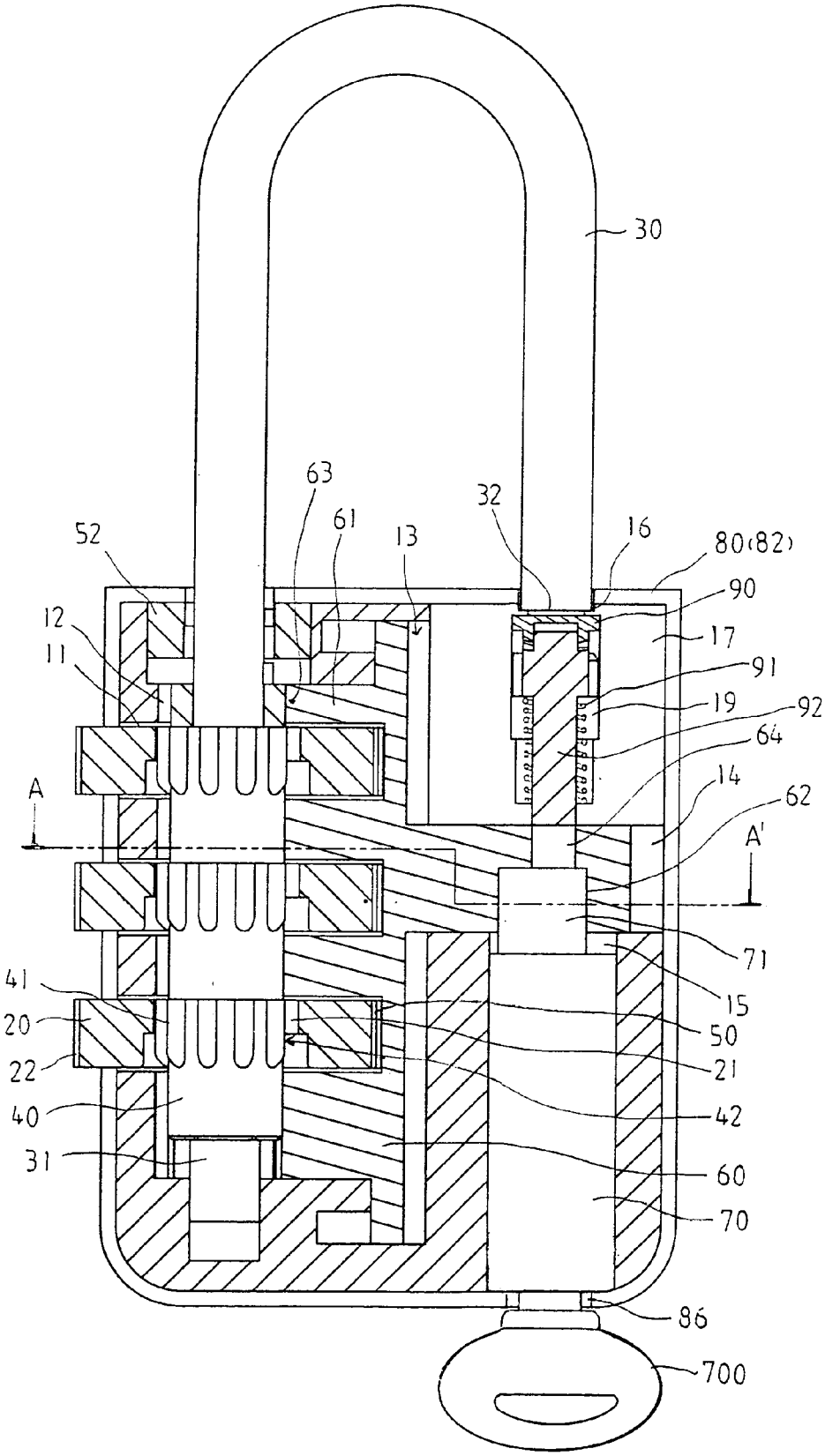
FIG. 2 is a cross-sectional view of the combination lock in an unlocked position.
Figure 3:
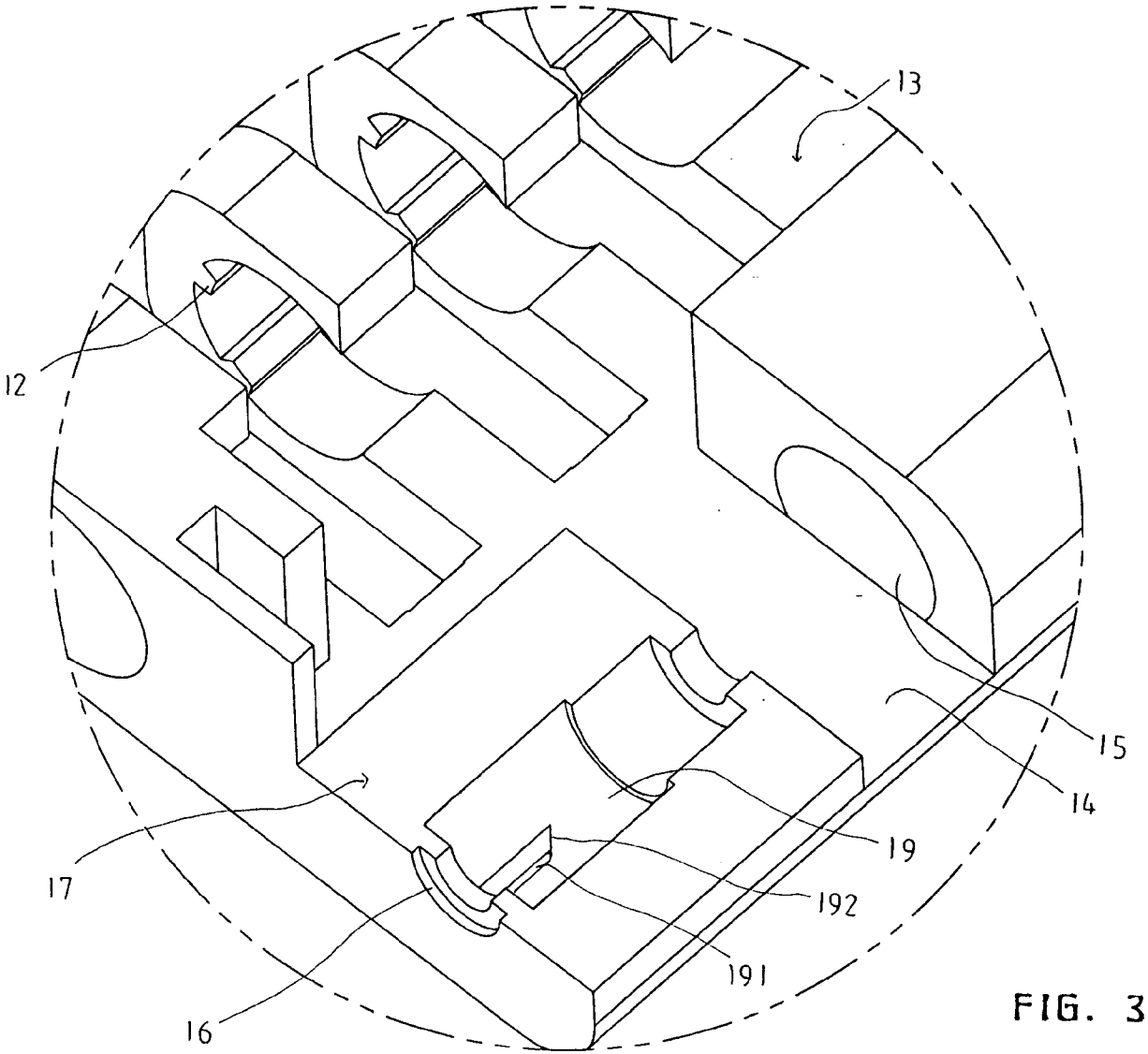
FIG. 3 is a greatly enlarged view of a portion of lock housing shown in FIG. 1.
Figure 4:
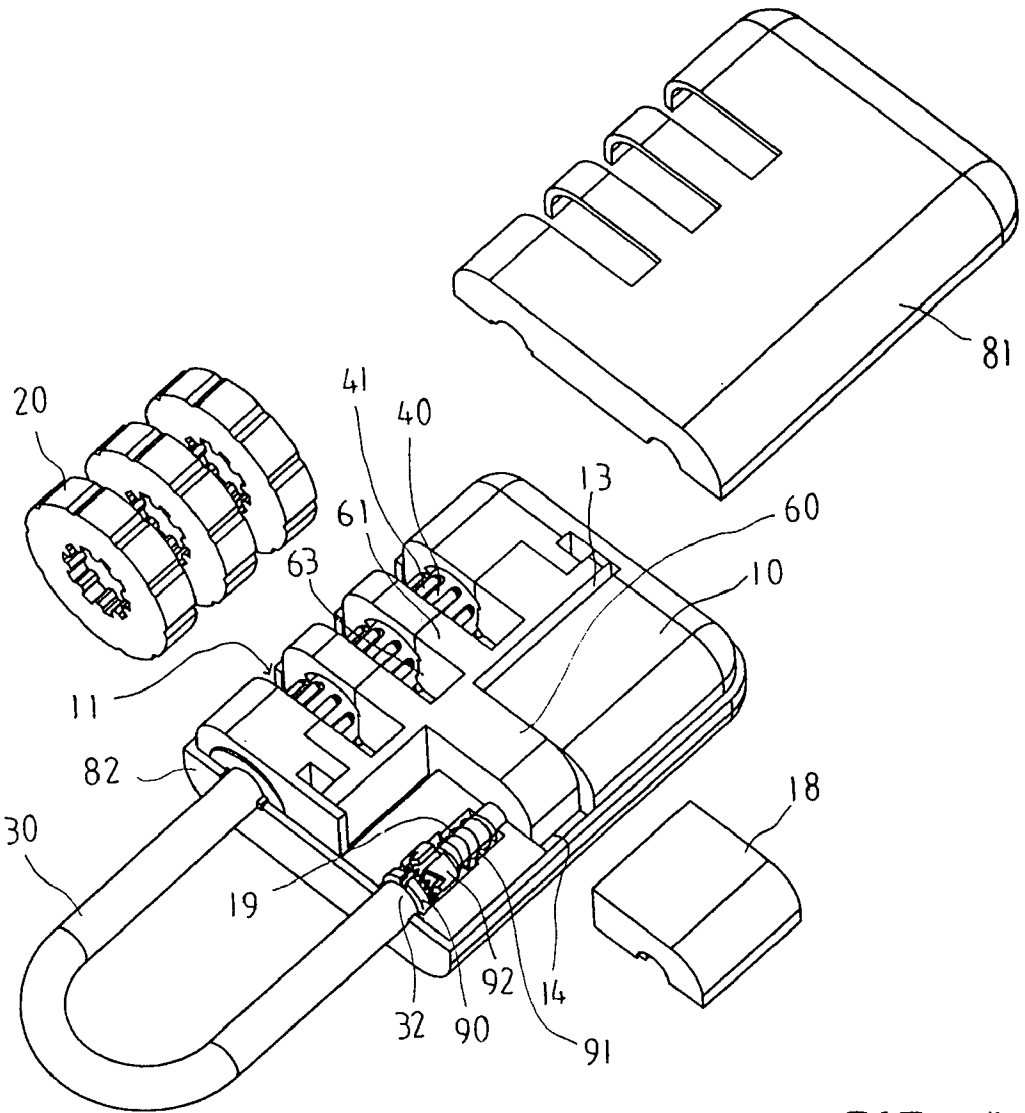
FIG. 4 is an exploded, perspective view of the combination lock.
Figure 5:
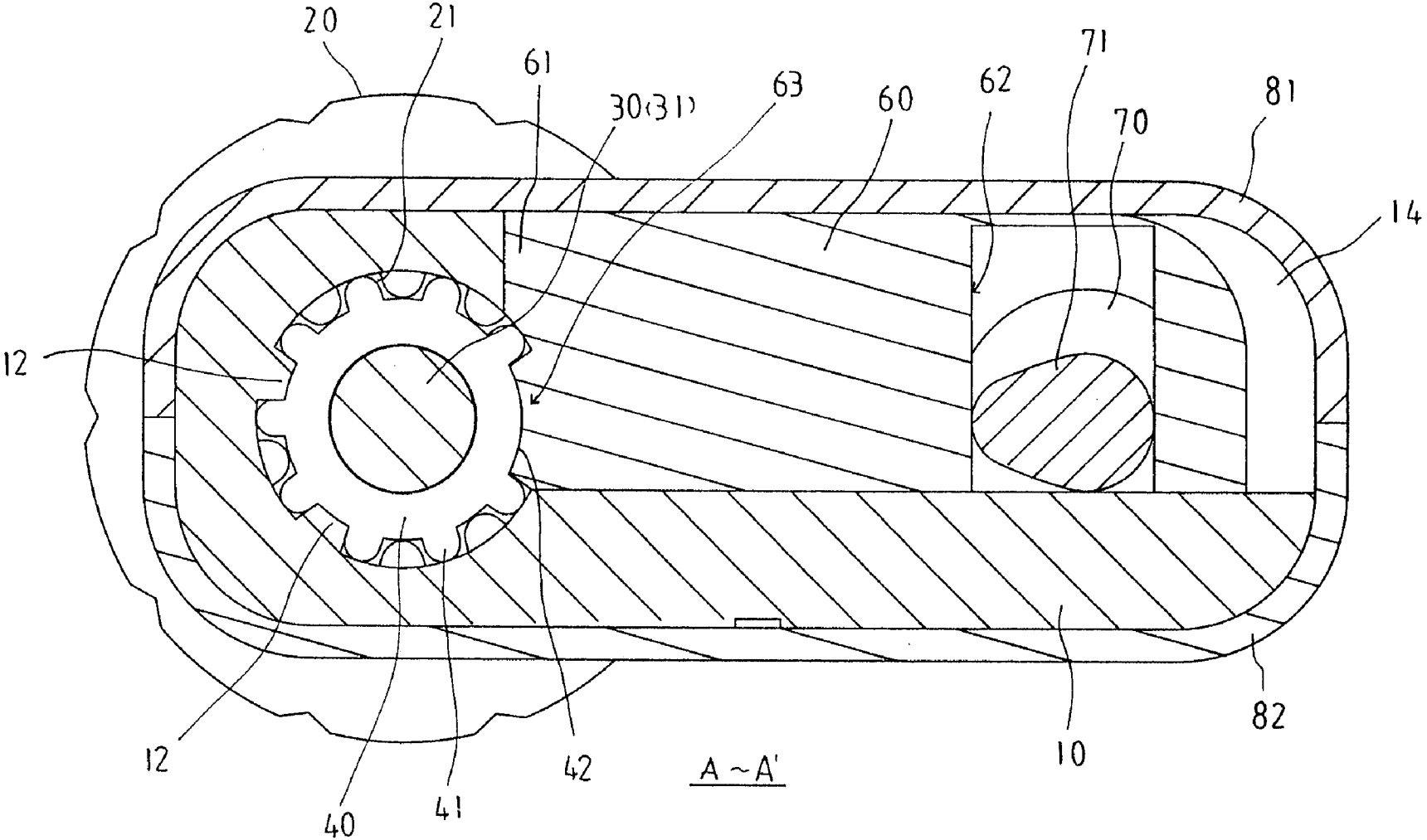
FIG. 5 is a cross-sectional view of the combination lock taken along line A–A' of FIG. 2.
Figure 7:
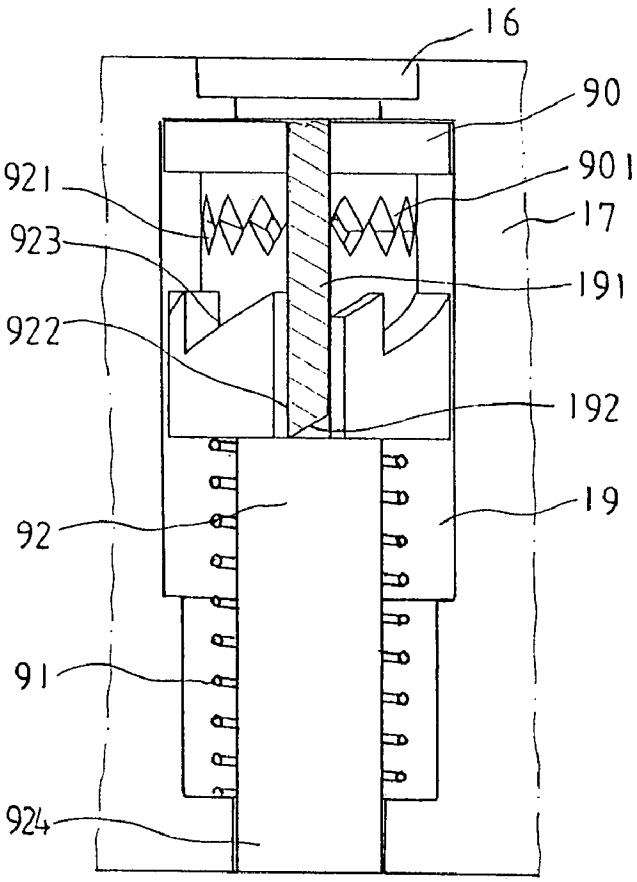
FIG. 7 is a cross-sectional view of the push button, the locking pin, and other associated components assembled in seat.
Figure 6:
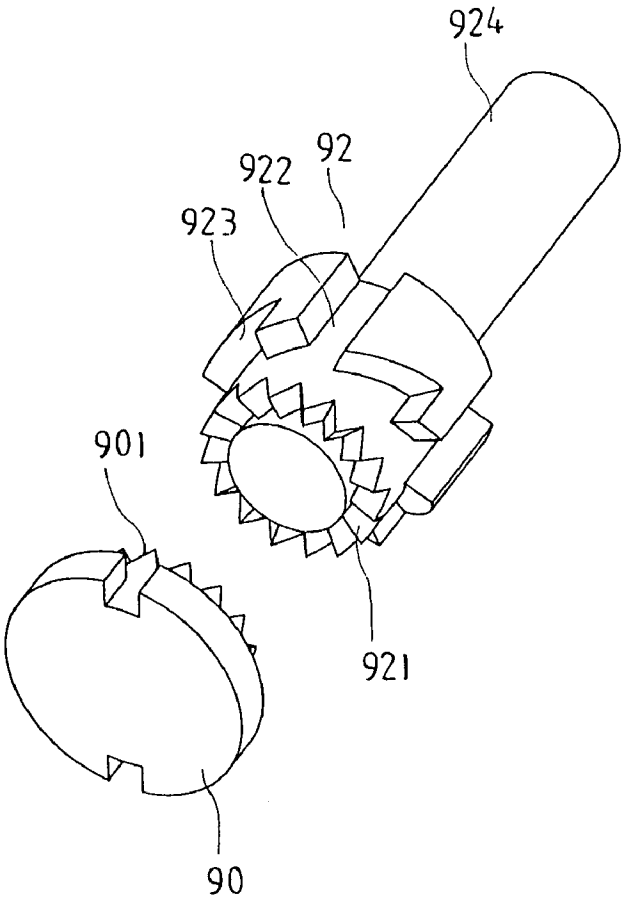
FIG. 6 is a perspective view of push button and locking pin.

Referring to FIGS. 1 to 19, a combination lock constructed in accordance with the invention is shown. The combination lock comprises a substantially parallelepiped body 10 including an elongated shackle receiving bore 101 extended from a top of the body 10 almost to a bottom thereof, a shallow shackle receiving hole 16 on the top of the body 10 opposite the bore 101, three parallel dial receiving slots 11 crossed the bore 101, a ridge 12 in an inner wall of the bore 101 adjacent each slot 11, a longitudinal groove 13 adjacent and parallel with the bore 101, a channel 14 perpendicular to the groove 13, a key hole 15 perpendicular to the channel 14, a cavity 19 recessed from the shackle receiving hole 16 and aligned with the key hole 15, the cavity 19 including a lengthwise ledge 191 having a slope 192 at its inner end, a seat 17 at both sides of the cavity 19, and a seat cover 18 rested on the seat 17; a housing 80 including mated upper and lower panels 81 and 82 each including a dial receiving recess 83, a first half-circular indentation 84 aligned with the bore 101, a second half-circular indentation 85 aligned with the shackle receiving hole 16, and a third half-circular indentation 86 aligned with the key hole 15; three separate and independent rotatable dials 20 mounted at the slots 11, each dial 20 including a plurality of slots 21 on its inner surface and a plurality of slits 22 on its outer surface on which a plurality of (e.g., ten) panels are formed with each slit 22 sandwiched between two adjacent panels wherein, for example, one numeral ranging from 0, 1, 2, 3, 4, 5, 6, 7, 8, and 9 is formed on each panel; three tumbler sleeves 40 each rotatably provided in the inner surface of the dial 20, each tumbler sleeve 40 including a plurality of radial fins 41 and a substantially flat member 42 around an outer surface wherein the number of the fins 41 is less than that of the slots 21 by one; a resilient element 50 including three legs 51 mounted in the slots 11 wherein each leg 51 is forced to engage with the slit 22 so that an audible click can be produced when the dial 20 is rotated to a proper orientation for each numeral; a washer 52 tightly fitted on the opening of the bore 101 for preventing any external contaminants from reaching the rotating components therein; an elongated key lock assembly 70 mounted in the key hole 15, the key lock assembly 70 including an inward projection 71 having a cam section; a T-shaped sliding seat 60 fitted onto the groove 13 and the channel 14, the sliding seat 60 including an opening 62 aligned with the key hole 15 so as to receive the projection 71 and cause the sliding seat 60 to be slidable by turning the key lock assembly 70, an aperture 64 in communication with the opening 62 and having a diameter smaller than that of the opening 62, and four legs 61 for forming three slots aligned with the slots 11, each leg 61 having a substantially arcuate member 63; a U-shaped shackle 30 including a short leg 32 having its end insertable into the shackle receiving hole 16 for being locked therein, and a long leg 31 having its end inserted into a bottom of the bore 101 and being allowed to advanced axially a small distance along the bore 101 in a locking or unlocking operation; a push button 90 including a toothed member 901 around an inner surface wherein an end of the short leg 30 is adapted to engage with the push button 90, and two opposite indentations on an outer surface; a locking pin 92 including a toothed member 921 around an end engageable with the toothed member 901, a plurality of equally spaced raised portions adjacent the toothed member 921 with a passage 922 formed between any two adjacent raised portions wherein the ledge 191 is fitted in one of the passages 922, a plurality of slopes 923 each at the raised portion, and a shaft 924 with the toothed member 921, the passages 922, and the slopes 923 formed therearound proximate one end; and a spring 91 put on the shaft 924 wherein the push button 90, the locking pin 92, and the spring 91 are disposed in the cavity 19 with only a small portion of the shaft 924 being extended to a position about flush with the edge of the seat 17.

Figure 12:
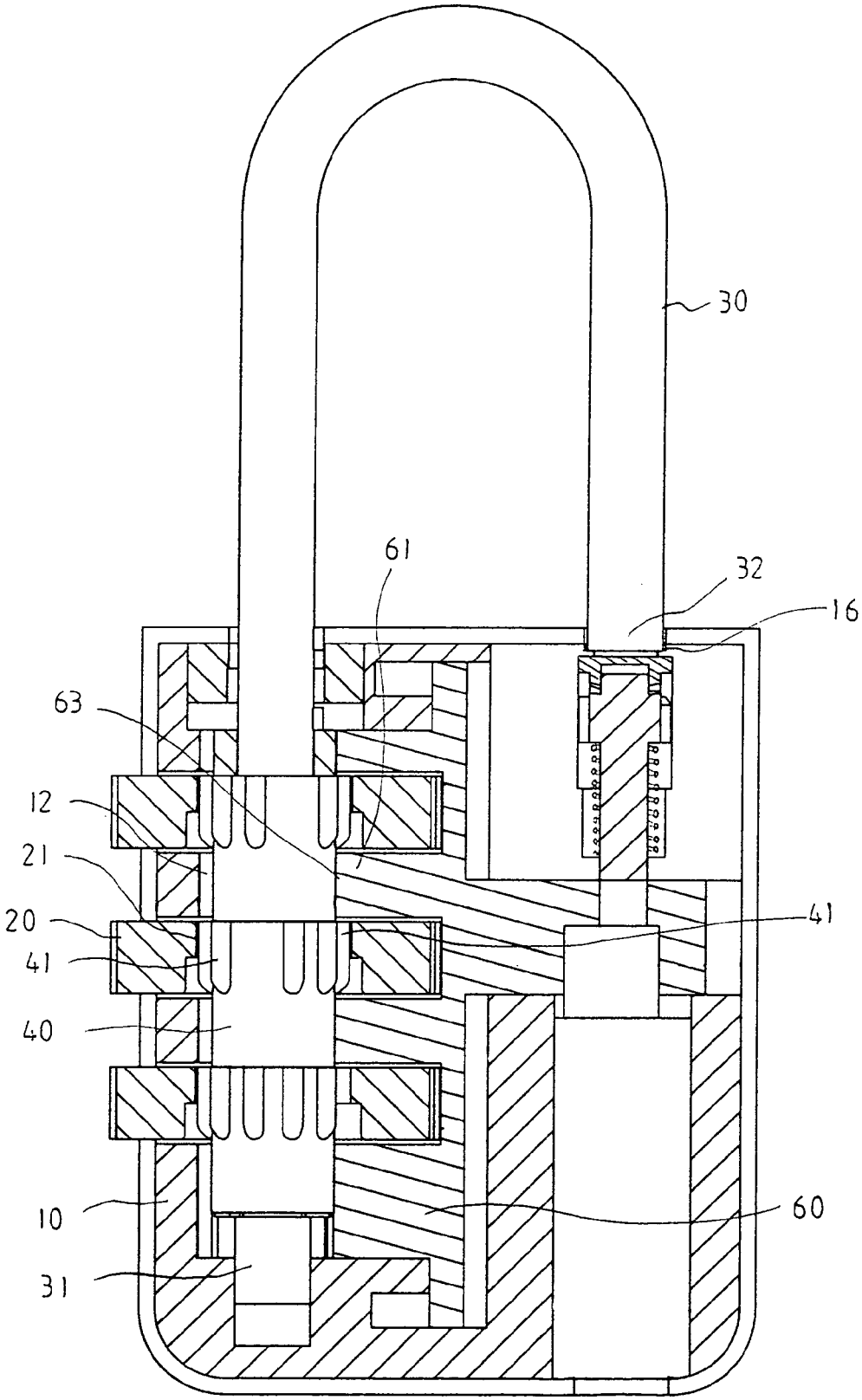
FIG. 12 is a cross-sectional view of the combination lock in a locked position.
Figure 13:
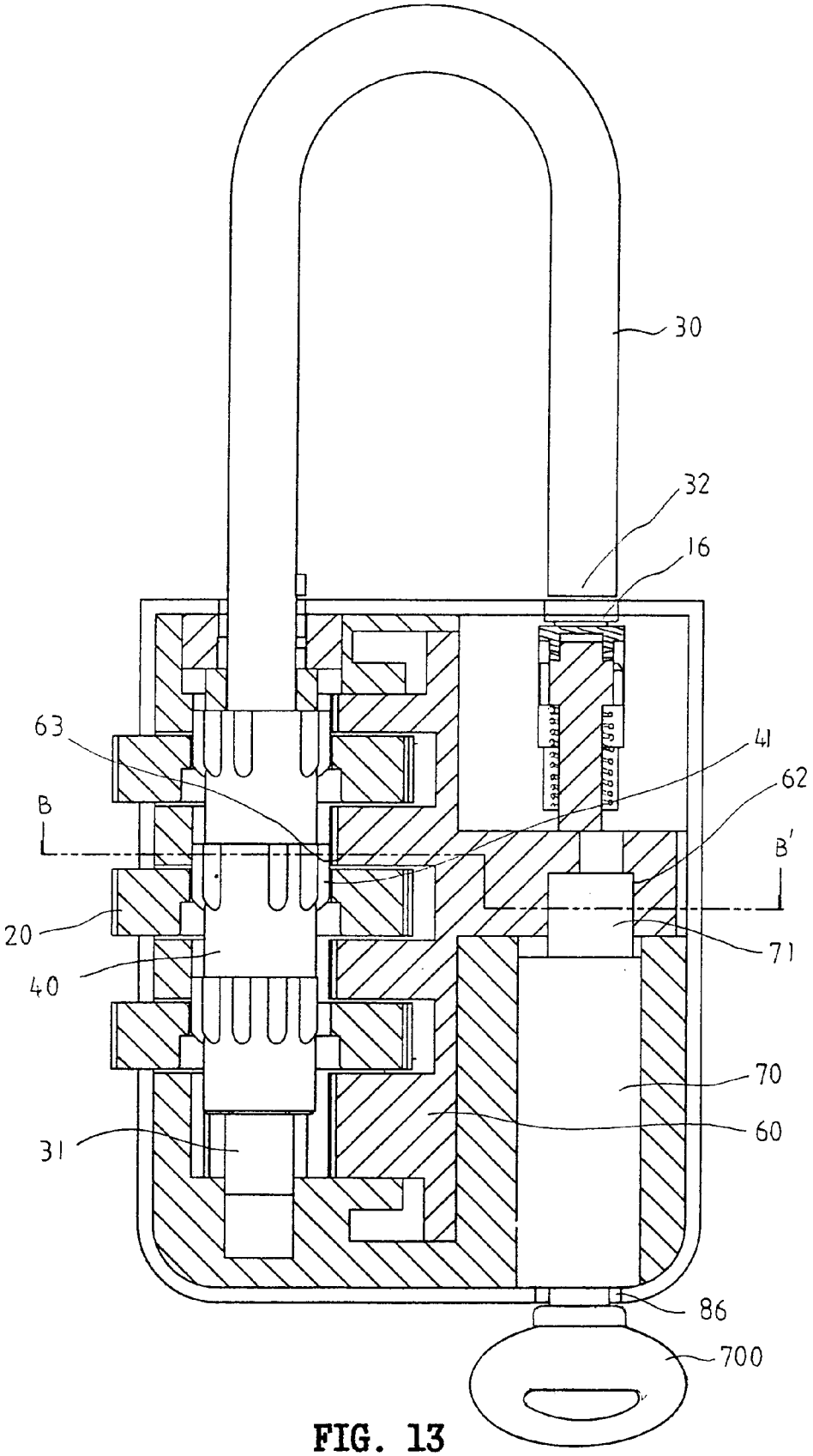
FIG. 13 is a cross-sectional view of the combination lock which is unlocked by a key.
Figure 14:
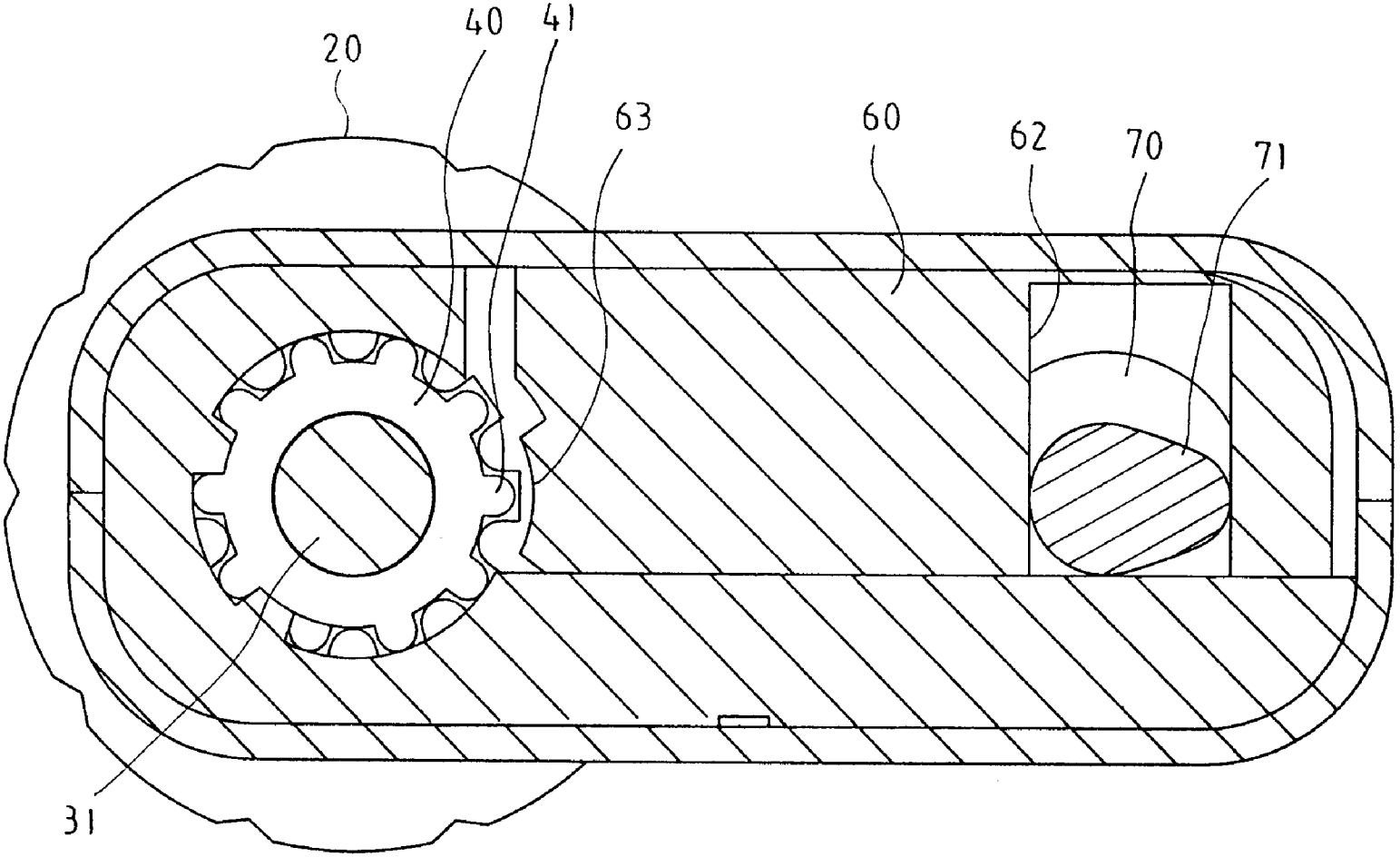
FIG. 14 is a cross-sectional view of the combination lock taken along line B–B' of FIG. 13.
Figure 15:
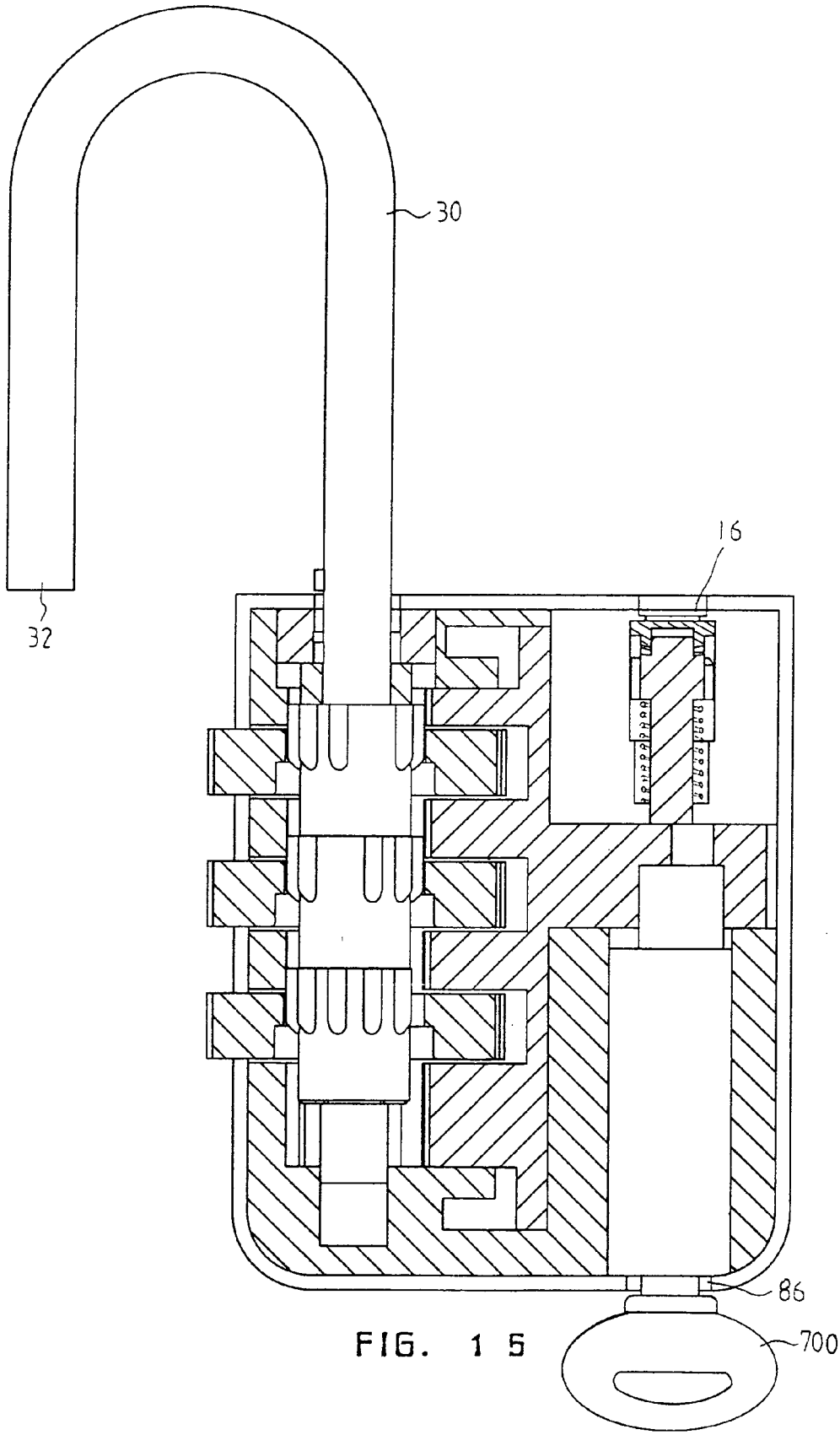
FIG. 15 is a cross-sectional view showing the pivoted shackle since the lock has been opened by a key.

The ridge 12 is inserted into a valley between two adjacent fins 41 of each tumbler sleeve 40 for locking. Also, the arcuate members 63 are urged against the flat member 42. Hence, an outward advancing of each of the long leg 31 and the short leg 32 is prevented, i.e., the combination lock is locked (FIG. 12). It is obvious that the lock can be opened once the arcuate members 63 are not urged against the fins 41 by arranging the dials 20 into a numeral sequence desired by the user. Alternatively, as shown in FIGS. 13, 14, and 15 it is possible to insert a key 700 into the key hole 15 to rotate the projection 71 for sliding the sliding seat 60 toward the side of the lock for disengaging the arcuate members 63 from the fins 41. This permits an outward advancing of each of the long leg 31 and the short leg 32 (i.e., the lock can be opened). Note that the inner end of the shaft 924 is always aligned with the aperture 64 in a non-operating state of the lock.

Figure 9:
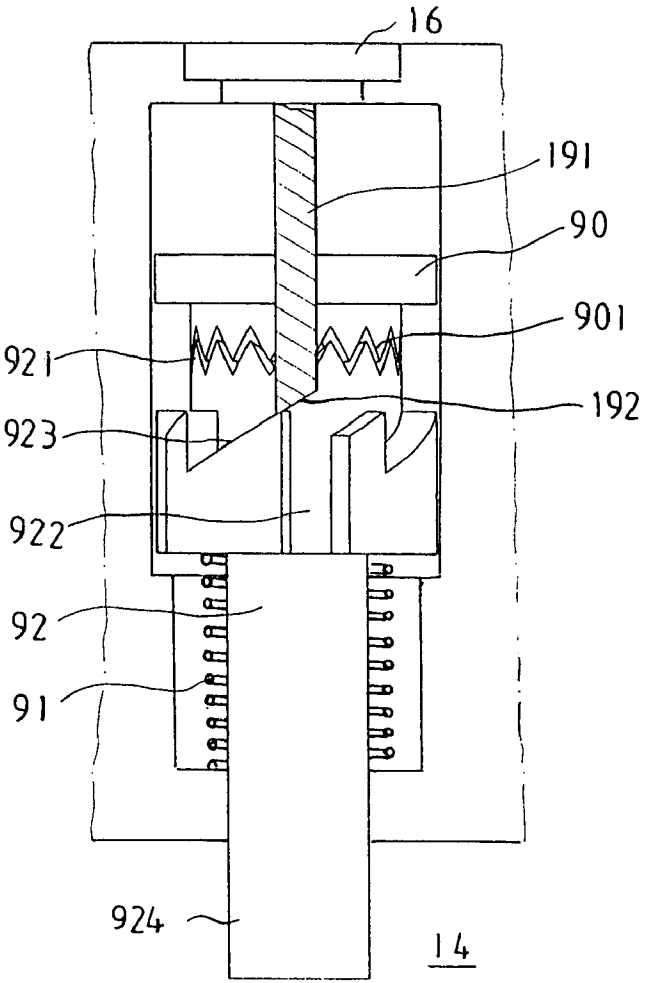
FIGS. 8, 9, 10, and 11 are views similar to FIG. 7 for illustrating operation of inhibiting an opening of the lock by a key by rotating the push button.
Figure 8:
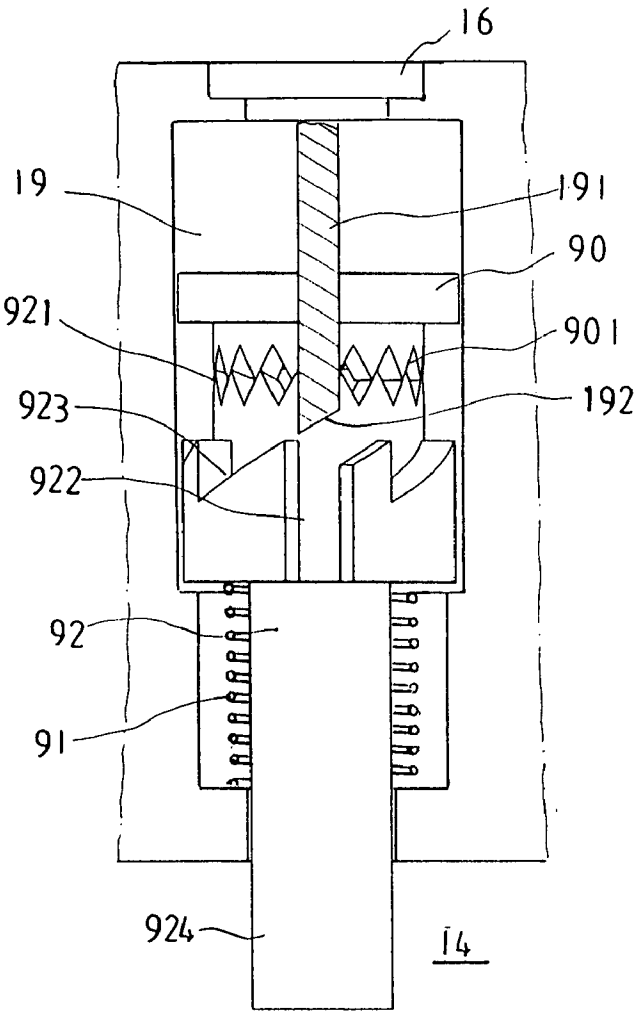
Figure 11:
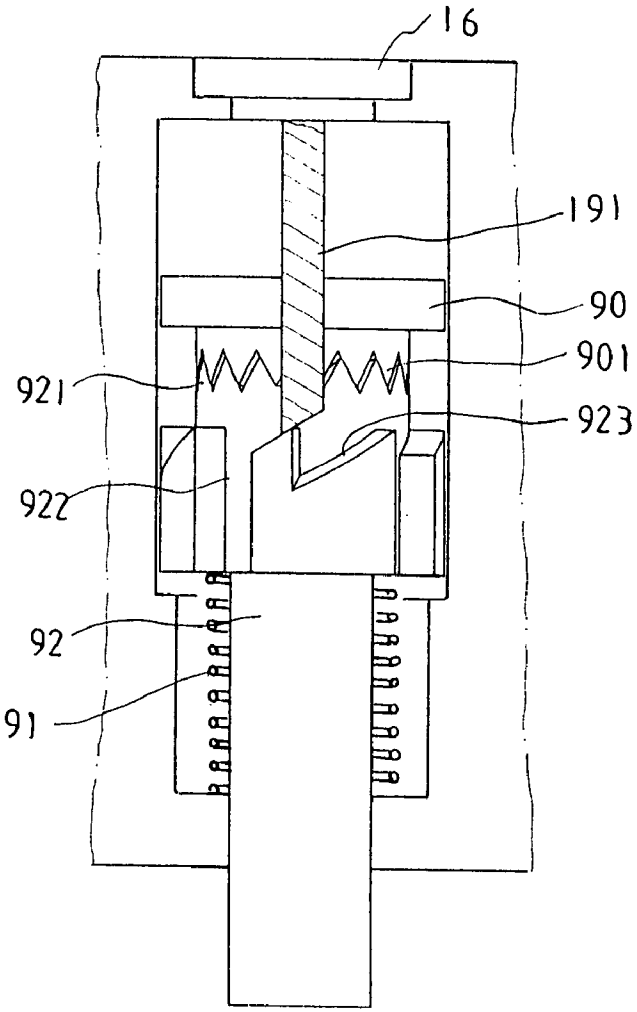
Figure 10:
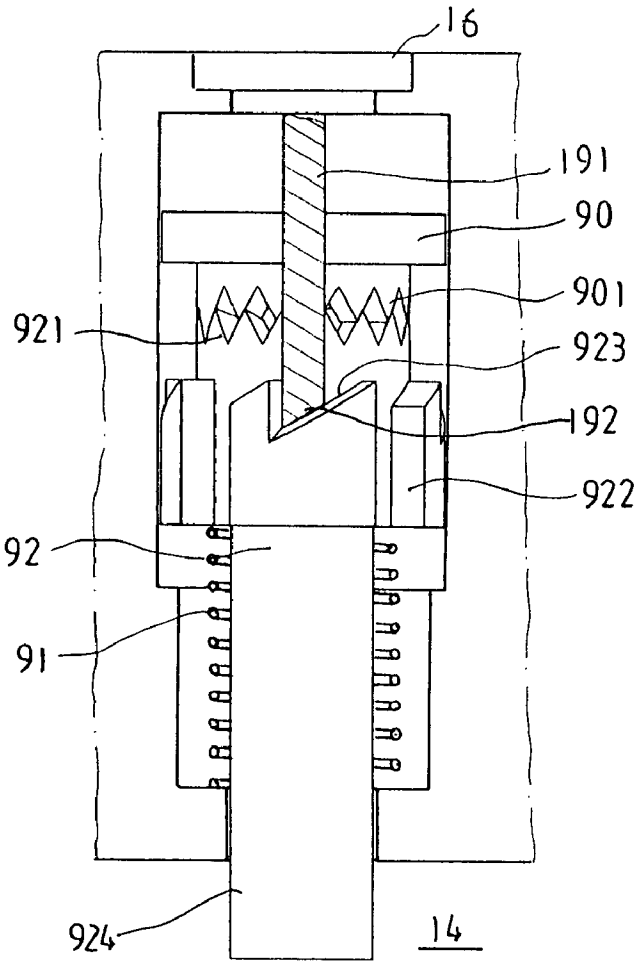
Figure 16:
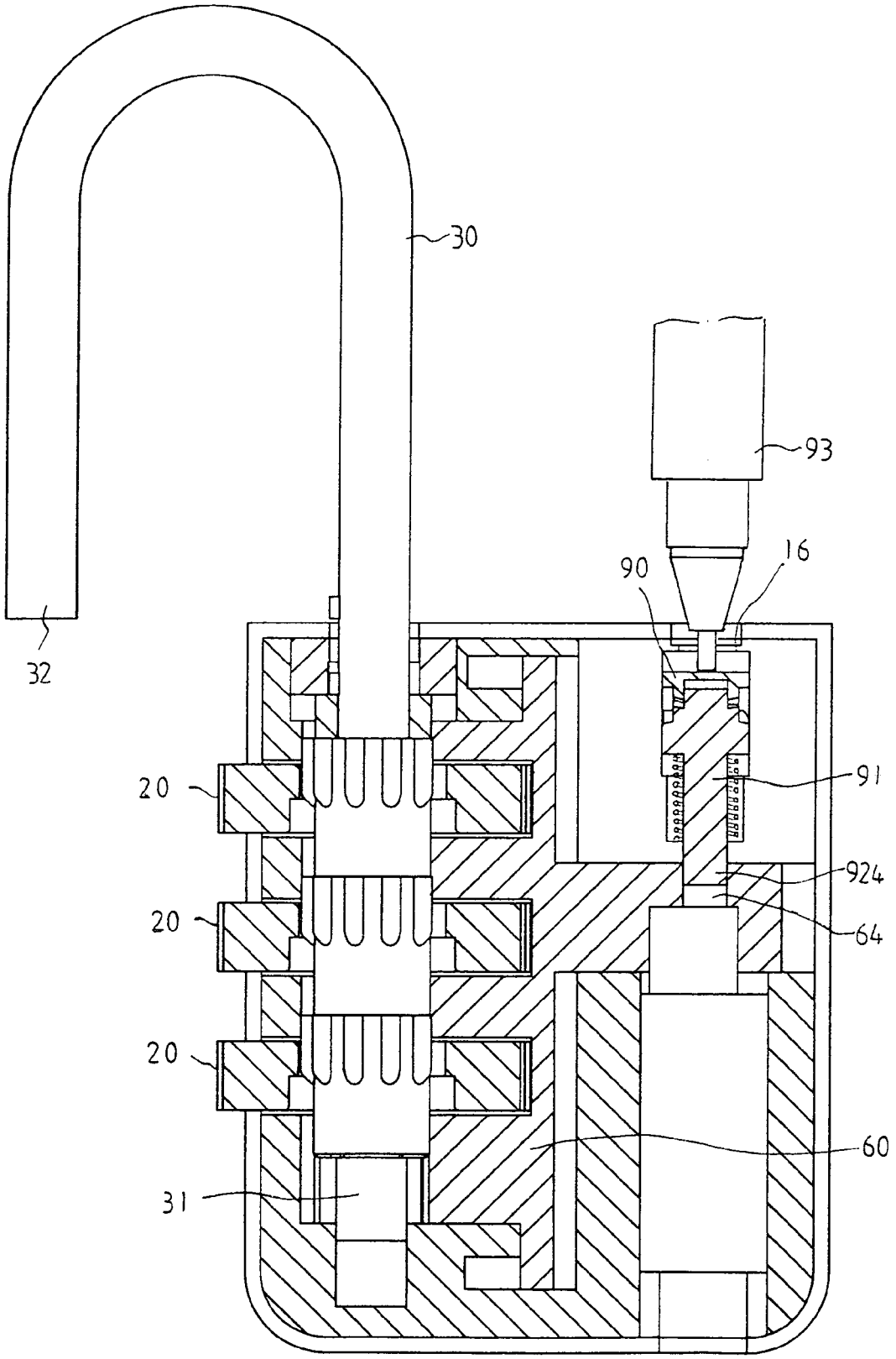
FIG. 16 is a cross-sectional view showing the insertion of locking pin into aperture for inhibiting any other person from opening the lock by a key after a short leg of shackle being pivoted about 180 degrees from its locked position in an unlocked state.
Figure 17:
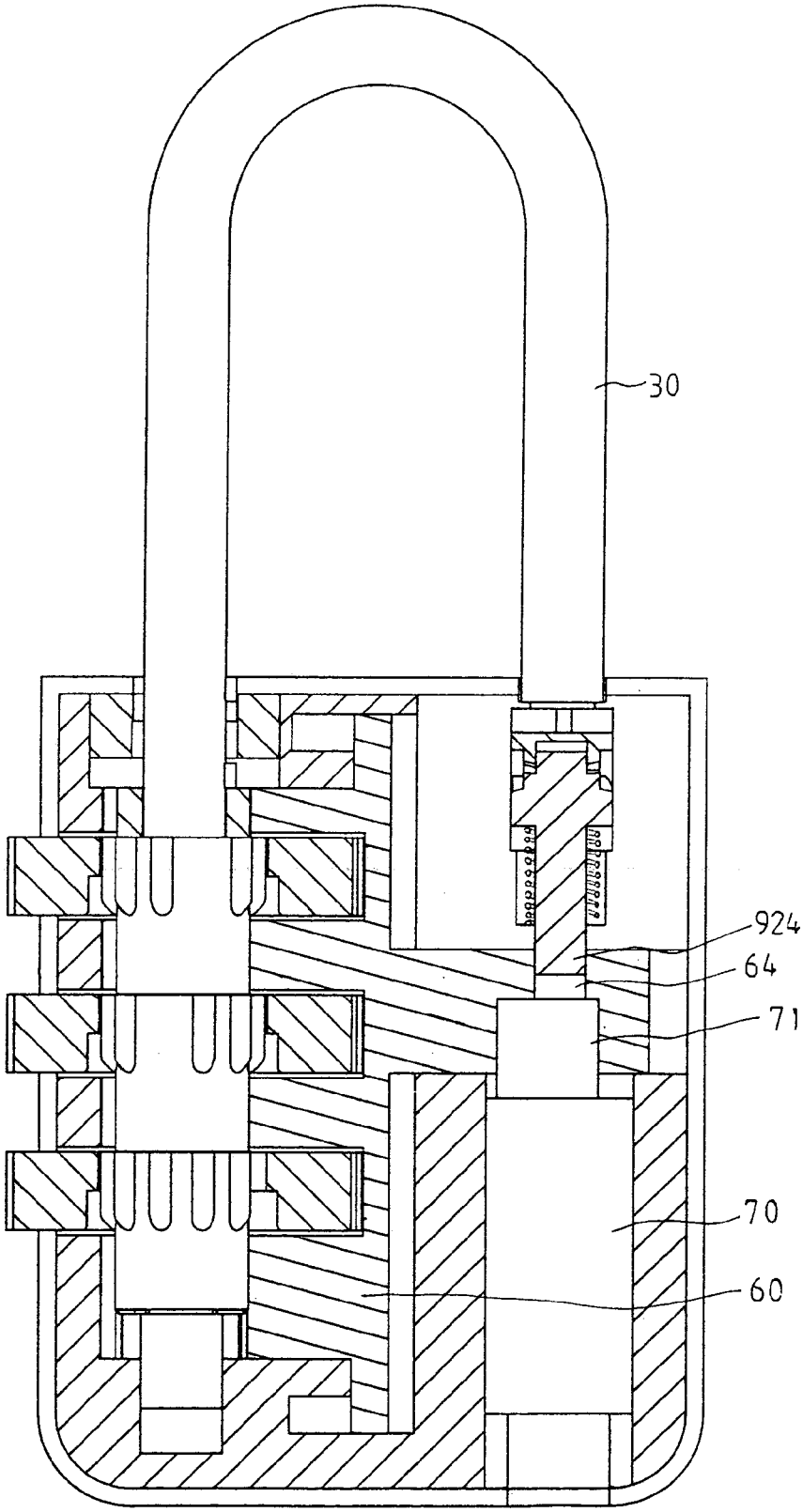
FIG. 17 is a cross-sectional view of the combination lock in a locked position, where opening the lock by a key is inhibited since the locking pin is inserted into the aperture.
Figure 18:
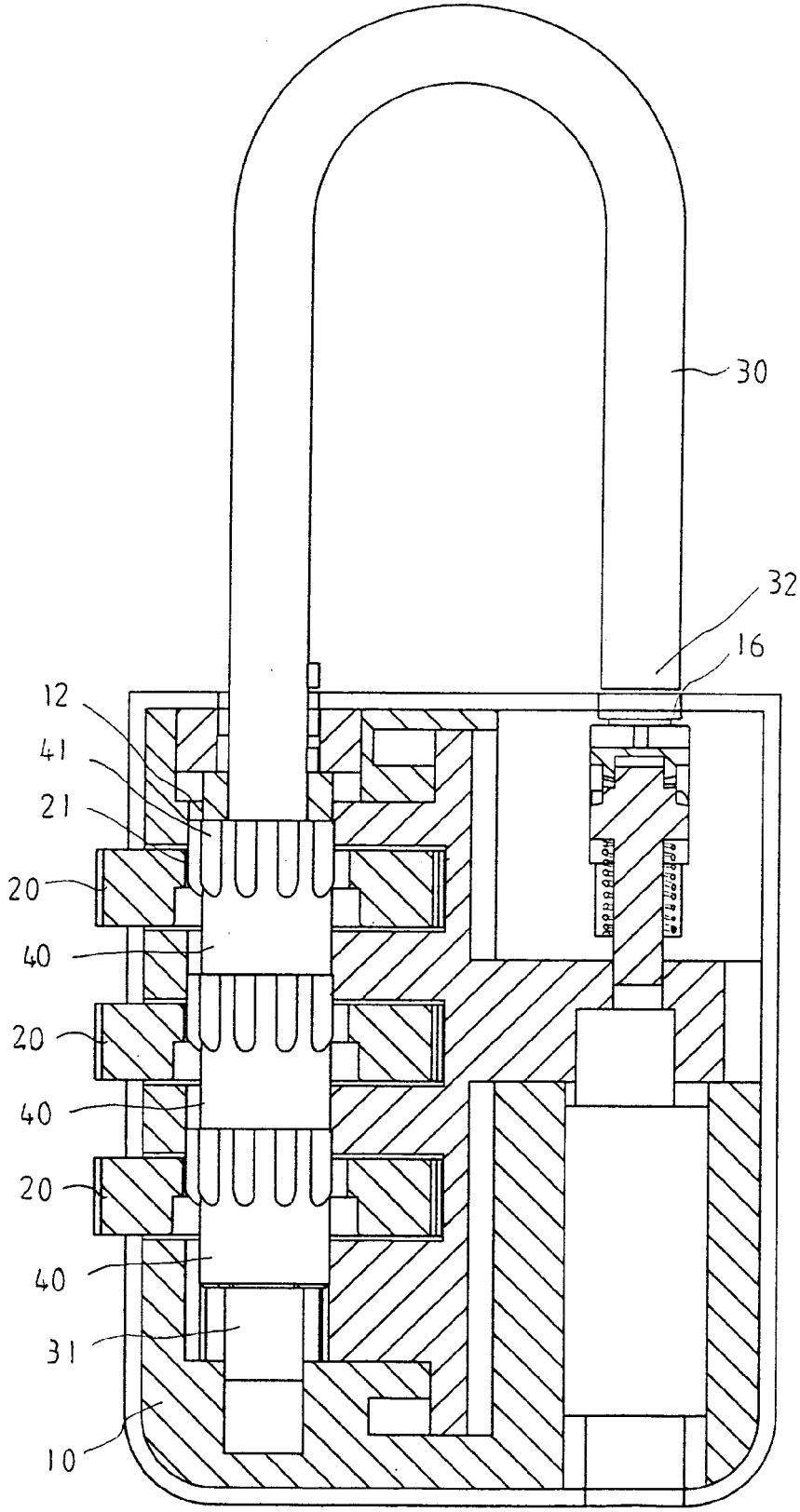
FIG. 18 is a view similar to FIG. 16, where short leg of shackle has pivoted back to a position slightly above a shackle receiving hole and an opening of the lock by a key still inhibited.

After unlocking the lock, for inhibiting any other person from opening the lock by a key, the following operations should be done in sequence. First, use a tool 93 (e.g., pen) to press the push button 90 to cause the push button 90 and the locking pin 92 to advance inside by compressing the spring 91 until the passage 922 is clear from the ledge 191 (FIG. 8). Next, insert a pointed portion of the tool 93 into either indentation on the push button 90 and rotate the push button 90 to cause the slope 192 to engage with and to be stopped by the slop 923 (FIGS. 9 and 10). At this position (FIG. 10), the push button 90 and the locking pin 92 are locked in the cavity 19. Next, use the tool 93 to press the push button 90 again to cause the push button 90 and locking pin 92 to advance further inside by compressing the spring 91 and the toothed member 921 to engage the toothed member 901 (FIG. 11). Then rotate the push button 90 and thus the locking pin 92 until the ledge 191 inserts into the passage 922 again. This completes the desired rotation of the push button 90 and the locking pin 92. Note that the shaft 924 enters into the aperture 64 for locking the sliding seat 60 by advancing the locking pin 92 in the inhibition operation. FIG. 16 shows the insertion of the shaft 924 into the aperture 64 after finishing the inhibition operation with the short leg 32 being pivoted about 180 degrees from its locked position in the unlocked state. Then pivot the shackle 30 to the position shown in FIG. 17 and lock the same. At this position, the lock can only be opened by arranging the dials 20 into a numeral sequence desired by the user (FIG. 18).

Figure 19:
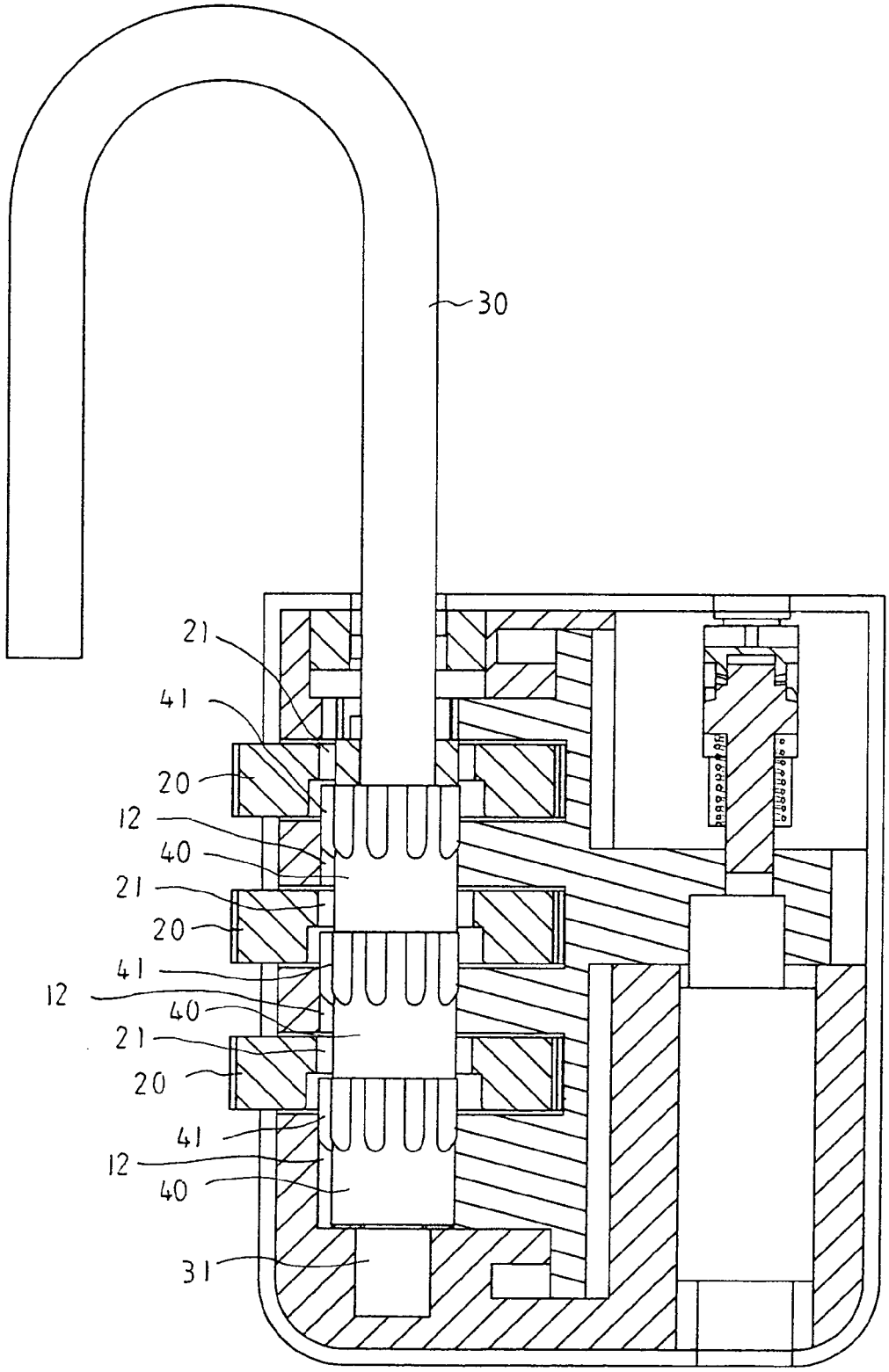
FIG. 19 is a cross-sectional view depicting the combination lock in its combination changing configuration.

As shown in FIG. 19, for changing the combination of the lock, in the unlocked position a user should pull the long leg 31 slowly by several steps (e.g., three steps in the embodiment) wherein in each step the fins 41 of one tumbler sleeve 4 are required to completely withdraw from the slots 21 of the dial 20 and be locked by one adjacent ridge 12, thereby enabling a change of one numeral of the combination.

While the invention herein disclosed has been described by means of specific embodiments, numerous modifications and variations could be made thereto by those skilled in the art without departing from the scope and spirit of the invention set forth in the claims.

What is claimed is:

1. A combination lock, comprising:

a substantially parallelepiped body including an elongated shackle receiving bore, a shallow shackle receiving hole on a top of the body opposite the bore, a plurality of parallel dial receiving slots crossed the bore, a plurality of ridges in an inner wall of the bore, each ridge being adjacent the dial receiving slot, a longitudinal groove adjacent and parallel with the bore, a channel perpendicular to the groove, a key hole perpendicular to the channel, a cavity recessed from the shackle receiving hole and aligned with the key hole, the cavity including a lengthwise ledge, a seat at both sides of the cavity, and a seat cover rested on the seat;

a housing including mated upper and lower panels each including a dial receiving recess, a first half-circular indentation aligned with the bore, a second half-circular indentation aligned with the shackle receiving hole, and a third half-circular indentation aligned with the key hole;

a plurality of separate and independent rotatable dials mounted at the dial receiving slots, each dial including a plurality of slits on an inner surface and a plurality of numeral panels on an outer surface;

a plurality of tumbler sleeves each rotatably provided in the inner surface of the dial, each tumbler sleeve including a plurality of radial fins and a substantially flat member around an outer surface wherein the number of the fins is less than that of the slits by one;

a resilient element including a plurality of pegs mounted in the dial receiving slots wherein each peg is forced to engage with the outer surface of the dial;

a washer tightly fitted on a mouth of the bore for preventing any external contaminants from reaching inside;

an elongated key lock assembly mounted in the key hole, the key lock assembly including an inward projection having a cam section;

a sliding seat fitted onto the groove and the channel, the sliding seat including an opening aligned with the key hole so as to receive the projection and cause the sliding seat to be slid able by turning the key lock assembly, an aperture in communication with the opening and having a diameter smaller than that of the opening, and a plurality of legs each aligned with a portion of the body between two adjacent dial receiving slots, each leg having a substantially arcuate member;

a U-shaped shackle including a short leg having its end insertable into the shackle receiving hole, and a long leg having its end inserted into a bottom of the bore and being allowed to advanced axially a distance along the bore in a locking or unlocking operation;

a push button disposed in the cavity being proximate the shackle receiving hole, the push button including a toothed section around an inner surface and two opposite indentations on an outer surface; and a spring biased locking pin including a toothed member around an end, a plurality of equally spaced raised portions adjacent the toothed member with a passage formed between any two adjacent raised portions and the ledge being fitted in one of the passages, a plurality of slopes each at the raised portion, a shaft aligned with the aperture, and a spring put on the shaft, wherein the ridge is inserted into a valley between two adjacent fins of each tumbler sleeve for locking with the arcuate members being urged against the flat member; the dials are arranged into a predetermined numeral sequence by disengaging the arcuate members from the fins for unlocking; insert a key into the key hole to rotate the projection for sliding the sliding seat and disengaging the arcuate members from the fins; in response to unlocking the lock, use a tool to press the push button to advance the push button and the locking pin inside until the passage is clear from the ledge, insert a pointed portion of the tool into at least one of the indentations, rotate the push button to engage the projection with the slope, further press the push button to advance the locking pin inside and matingly engage the toothed member with the toothed section, and rotate the push button and the locking pin until the ledge inserts into the passage with the shaft being entered into the aperture for locking the sliding seat during an operation of inhibiting the lock from being opened by the key; and responsive to unlocking the lock, pull the long leg by a plurality of steps wherein in each step the fins of the tumbler sleeve are completely withdrawn from the slits and are locked by one adjacent ridge, thereby enabling a change of one numeral of a predetermined combination.

2. The combination lock of claim 1, wherein the projection comprises an oblique surface at an end.

* * * * *